United States Patent [19]

Bennett

[11] 4,369,890

[45] Jan. 25, 1983

[54] PAINT CAN COLLAR

[76] Inventor: Gordon C. Bennett, 500 Isle of Capri, Fort Lauderdale, Fla. 33301

[21] Appl. No.: 190,345

[22] Filed: Sep. 24, 1980

[51] Int. Cl.[3] ..... B65D 25/00; B65D 25/48

[52] U.S. Cl. ..... 220/85 R; 220/4 A; 220/90; 220/287; 222/570

[58] Field of Search ..... 220/90, 85 R, 4 A, 287; 222/570; D7/187; D9/447

[56] References Cited

U.S. PATENT DOCUMENTS

| | | | |
|---|---|---|---|
| D. 248,218 | 6/1978 | Clumb | D9/447 |
| 1,734,328 | 11/1929 | Conry | 220/4 A X |
| 1,834,402 | 12/1931 | Houston . | |
| 2,030,344 | 2/1936 | Young . | |
| 2,077,868 | 4/1937 | Adams . | |
| 2,151,895 | 3/1939 | Carlson | 220/90 |
| 2,420,487 | 5/1947 | Lons | 220/90 |
| 2,564,979 | 8/1951 | Jorgensen | 220/90 |
| 2,591,482 | 4/1952 | Weltlich | 220/90 |
| 2,668,635 | 2/1954 | Bennett | 220/85 |
| 2,771,208 | 11/1956 | Chovanes | 220/90 X |
| 3,133,666 | 5/1964 | Henchert | 220/307 |
| 3,463,366 | 8/1969 | Spencer | 222/570 |
| 3,853,249 | 12/1974 | Weir et al. | 222/570 |
| 3,994,424 | 11/1976 | Koeller | 222/570 |

*Primary Examiner*—Allan N. Shoap

*Attorney, Agent, or Firm*—Griffin, Branigan & Butler

[57] ABSTRACT

A paint can collar comprising a generally circular body having a lower lip portion for engagement with the rim of a paint can, an intermediate portion resting upon the top of the paint can, and an upper lip portion outwardly and upwardly projecting from the intermediate portion so that any spilled paint will return into the paint can. The lower lip portion also includes a plurality of tabs to maintain the paint can collar in engagement with the inner rim of the paint can. The body is designed to have a variable diameter to fit various size paint cans. The upper lip portion may also include a pair of bisymmetrical indentations so that the handle of the paint can may be moved into a functional position for carrying the paint can without removing the paint can collar.

3 Claims, 5 Drawing Figures

PAINT CAN COLLAR

BACKGROUND OF THE INVENTION

In the past there have been various devices in order to overcome the problem of paint dripping down the side of the paint can. However, most of the devices have been limited to use with predetermined sized paint cans made from relatively expensive materials. The present invention overcomes the deficiencies in the prior art by providing a simple, inexpensive variable diameter paint can collar which prevents the dripping of paint down the sides of the can onto the surface to which the can rests.

SUMMARY OF THE INVENTION

According to the present invention, a simple inexpensive paint can collar is provided. The paint can collar comprises a generally circular body having a lower lip portion for engagement with the inner rim of a paint can, an intermediate portion which rests upon the inner rim of the can and an upper lip portion projecting outwardly and upwardly from the intermediate portion such that the spilled paint will eventually drip back into the paint can when spilled. The upper lip portion also includes a pair of bisymmetrical indentations designed to enable the handle of the paint can to be moved into a position to carry the paint can. The body is cut so that a first end portion and a second end portion are formed. The first end portion is designed to slideably engage with the second end portion in order that the inner diameter of the lower lip portion may be varied according to the size of the paint can being used.

It is therefore the primary object of this invention to provide a simple, inexpensive paint can collar which may be adapted to fit various sized paint cans.

It is another object of this invention to provide a paint can collar which enables the handle of the paint can to be placed in the functional position for carrying the paint can without having to remove the paint can collar.

In accordance with these and other objects which will be apparent hereinafter, the instant invention will now be described with particular reference to the accompanying drawings.

DESCRIPTION OF THE PREFERRED EMBODIMENT

Figure 1:
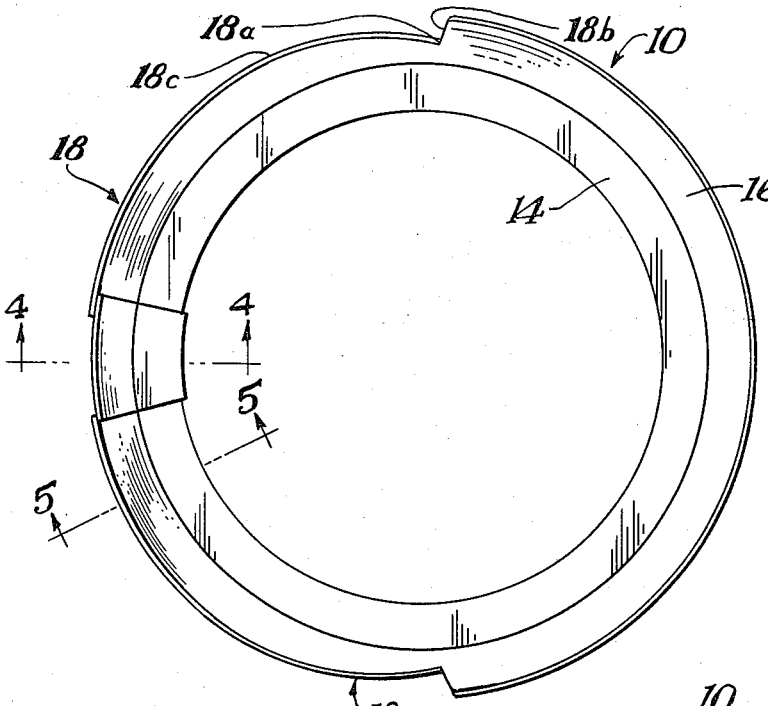
FIG. 1 is a top elevational view of the invention.
Figure 2:
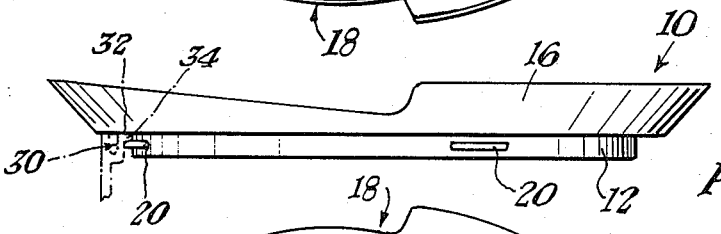
FIG. 2 is a side elevational view of the invention.
Figure 3:
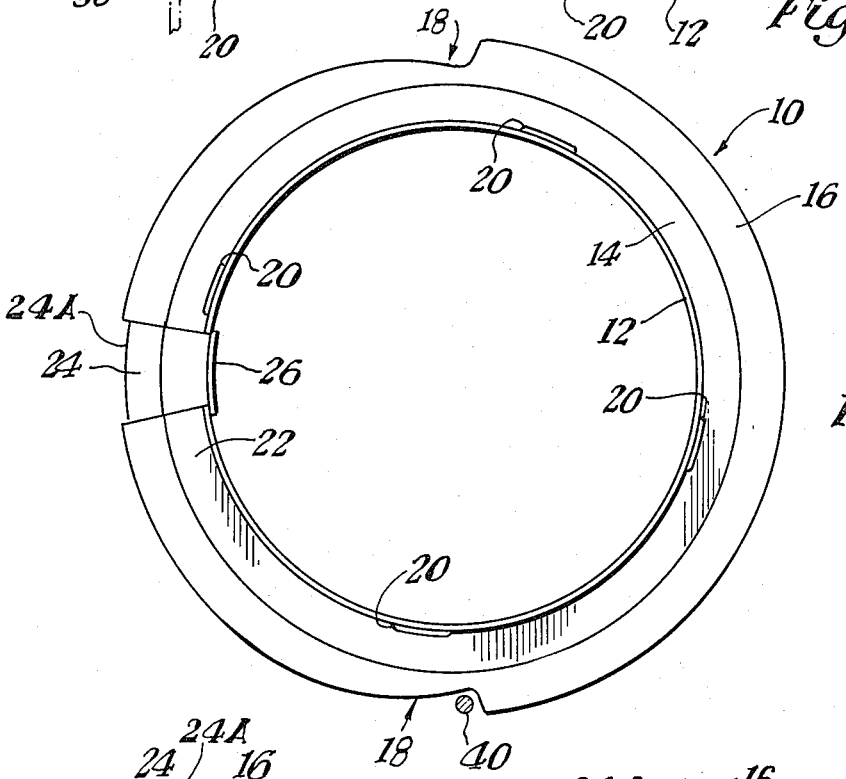
FIG. 3 is a bottom elevational view of the invention.

Referring now to the drawings and more particularly FIGS. 1, 2, and 3, the paint can collar is shown generally at 10. The collar comprises a lower lip portion 12, intermediate portion 14 and an upper lip portion 16.

The lower lip portion 12 is generally parallel to the side wall of the paint can illustrated by 30 in FIG. 2 into which the paint can collar lower lip portion 12 is to be inserted and is maintained in engaging relation with the inner rim below the inwardly extending lip 34 of a paint can by way of plurality of tabs or flanges 20. The intermediate portion 14 is generally coplanar with the plane of the top surface 32 of the paint can and rests upon the rim portion of the paint can once the top is removed. The upper lip portion 16 extends outwardly and upwardly from the intermediate portion 14 in order that any paint drippings will eventually flow downwardly and inwardly towards the opening in the paint can without dripping along the side of the paint can. The upper lip portion 16 also includes a pair of bisymmetrical indentations 18, having abrupt angles **18*a* defined by abrupt abutting edges 18*b* and gradually tapering edges 18*c*, which enables the paint can collar to remain attached to the paint can when the paint can is being removed. It is therefore necessary to align the indentation 18 with the path of the paint can handle 40 shown in FIG. 3** when placing the paint collar on the can.

Figure 4:
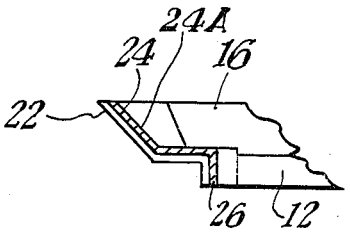
FIG. 4 is a partial cross-sectional view of the invention taken across the line 4—4 of FIG. 1 looking in the direction of the arrows.
Figure 5:
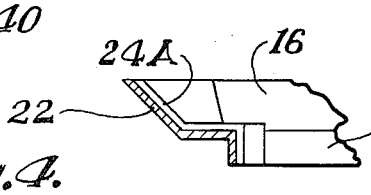
FIG. 5 is a cross-sectional view taken on line 5—5 of FIG. 1.

Referring to FIGS. 3 and 4, the two end portions 22 and 24 are shown. The first end portion 22 is completely separated from the second end portion 24 so that the diameter of the lower lip portion 12 may be varied according to the size of the can. The second end portion 24 also includes an inwardly offset guiding lip 26 and an upwardly offset section 24A which allows the first end portion 22 to slide there along maintaining the lower lip portion 12, the intermediate portion 14 and the upper lip portion 16 in proper position. In this embodiment, it is suggested that a high impact styrene plastic be used in the manufacture of the collar as it gives the collar a resilient characteristic which expansively biases the diameter of the lower lip portion to maintain the collar in engagement with the inner rim of the paint can. It should be noted that other materials could be used which are nonresilient and a spring or set of springs could be used to expansively bias the diameter of the device to maintain the engagement with the paint can. A preferred material is a high impact styrene.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. In a paint can collar of a type mountable on paint cans at their openings for preventing the dripping of paint and the filling of paint-can lid grooves, and of a type comprising a substantially annularly-shaped variable diameter body, said annularly-shaped body having a lower-lip portion with a greater diameter than said paint-can openings for being compressed and inserted into said openings and then expanding outwardly into engagement with inner walls of paint cans and an intermediate lip for extending over said paint-can lid grooves when said paint can collar is mounted on said paint cans, said annularly-shaped body being split at one place about its circumference to define two ends and adjacent end portions, said annularly-shaped body being constructed of resilient material which, when said annularly-shaped body is compressed, biases said annularly-shaped body to expand, with said end portions moving relative to one another and said lower-lip portion being urged outwardly into engagement with paint can walls, the improvement wherein:

said body has an upper lip portion outwardly projecting from said intermediate portion beyond the outer diameters of the paint cans, said upper lip portion defining a pair of radially-directed indentations for being placed into alignment with paint-can handles when they are placed in upright positions for lifting paint cans on which the collar is mounted, both of said indentations each having a substantially abrupt abutment corner at the intersection of an abutting edge and a gradually-tapering edge of the upper lip, the respective abutting edges extending substantially radially from said intermediate portion and being lateral to and defining substantially straight, diametrically opposed, ends of a first arcuate portion of said upper lip portion, the respective gradually-tapering edges each extending from a second arcuate portion opposite said first arcuate portion, said second arcuate portion tapering gradually radially inwardly from a location distal from each of said abutting edges and ending at respective abrupt abutment corners, said gradually tapering edges allowing a handle to be easily moved into each of said indentations, while said abutting edges inhibit further movement of said handle beyond said indentations.

2. In a paint can collar of a type mountable on paint cans at their openings for preventing the dripping of paint and the filling of paint-can lid grooves, and of a type comprising a substantially annularly-shaped variable diameter body, said annularly-shaped body having a lower-lip with a greater diameter than said paint can openings for being compressed and inserted into said openings and then expanding outwardly into engagement with inner walls of the paint cans and an intermediate lip for extending over said paint-can lid grooves when said paint can collar is mounted on said paint cans, said annularly-shaped body being split at one place about its circumference to define two ends and adjacent end portions, said annular body being constructed of resilient material which, when said end portions are overlapped to reduce the diameter of said annularly-shaped body, biases said annularly-shaped body to expand with said end portions sliding relative to one another and said lower-lip being urged outwardly into engagement with paint can walls, the improvement wherein:

the main portion of said lower lip and said intermediate portion being configured to form a circular shape, but a first end portion of said lower lip on one side of said slit being radially inwardly, offset from a second end portion of said lower lip on the other side of said slit so that as the two lower-lip end portions slide along one another when overlapped, the first offset end portion allows the second end portion to be in lateral circular registration with the remainder of said lower lip except for the offset lower lip end portion and wherein a first intermediate lip end portion, corresponding to said first end portion of said lower lip, is upwardly offset from a second end portion of said intermediate lip on the other side of said slit so that as the two intermediate-lip end portions slide along one another when overlapped, circular registration of said intermediate lip except for the offset intermediate-lip end portion is allowed.

3. A paint can collar as in claim 2 wherein said body has an upper lip outwardly projecting from said intermediate lip beyond the outer diameter of the paint can and wherein said upper lip has an end portion corresponding to said first end portion of said lower lip which is offset from a second end portion of said upper lip on the other side of said slit so that as the two upper lip end portions slide along one another when overlapped, circular registration of said upper lip, except for the offset upper-lip end portion, is allowed.

* * * * *